US007836738B2

(12) United States Patent
Tien et al.

(10) Patent No.: US 7,836,738 B2
(45) Date of Patent: Nov. 23, 2010

(54) MORTISE LOCK FOR ORDINARY DOOR AND PANIC DOOR

(75) Inventors: Hung-Jen Tien, Tainan (TW); Chen-Wei Huang, Tainan (TW)

(73) Assignee: I-Tek Metal MFG. Co., Ltd., Tainan (TW)

( * ) Notice: Subject to any disclaimer, the term of this patent is extended or adjusted under 35 U.S.C. 154(b) by 364 days.

(21) Appl. No.: 12/144,771

(22) Filed: Jun. 24, 2008

(65) Prior Publication Data

US 2009/0314043 A1 Dec. 24, 2009

(51) Int. Cl.
*E05B 55/06* (2006.01)
*E05C 1/12* (2006.01)

(52) U.S. Cl. ..... 70/149; 70/107; 70/218; 70/224; 292/169.14; 292/336.5

(58) Field of Classification Search ..... 70/107, 70/149, 218, 221–224, 472; 292/165, 169.14–169.17, 292/169.21–169.23, 336.5, DIG. 27
See application file for complete search history.

(56) References Cited

U.S. PATENT DOCUMENTS 3,672,714 A * 6/1972 Schultz ..... 70/107
6,050,115 A * 4/2000 Schroter et al. ..... 70/107
6,302,456 B1 * 10/2001 Errani ..... 70/107
6,581,423 B2 * 6/2003 Lin ..... 70/107
6,619,705 B2 * 9/2003 Dalsing ..... 292/169.14
6,851,287 B1 * 2/2005 Yang et al. ..... 70/107
6,993,946 B1 * 2/2006 Shen ..... 70/107
7,303,215 B2 * 12/2007 Moon et al. ..... 292/169.14
7,377,140 B2 5/2008 Shen et al.
7,497,486 B1 * 3/2009 Davis et al. ..... 292/169.14
7,603,880 B2 * 10/2009 Chen ..... 70/107

* cited by examiner

*Primary Examiner*—Peter M Cuomo
*Assistant Examiner*—Christopher Boswell
(74) *Attorney, Agent, or Firm*—Alan Kamrath; Kamrath & Associates PA

(57) ABSTRACT

A mortise lock includes a case having first and second sidewalls. A follower plate is pivotably mounted in the case and actuatable by a key-operable cylinder to move a latch bolt from an extended position to a retracted position. A locking plate is moveable by the cylinder through transmission by a lever link between an unlocking position allowing movement of the latch bolt and a locking position not allowing movement of the latch bolt. The locking plate is active when a connecting member is slideably extended through a slot in the first sidewall and through an engaging hole of the lever link into another engaging hole in the follower. The locking plat is inactive when the connecting member is slideably extended through another slot in the second sidewall and engaged in the engaging hole of the follower and not engaged in the engaging hole of the lever link.

11 Claims, 15 Drawing Sheets

MORTISE LOCK FOR ORDINARY DOOR AND PANIC DOOR

BACKGROUND OF THE INVENTION

The present invention relates to a mortise lock and, more particularly, to a mortise lock that can be utilized with both an ordinary door and a panic door.

Mortise locks having complicated structure are generally utilized on ordinary doors to provide enhanced security as well as multiple functions. As an example, U.S. Pat. No. 7,377,140 issued May 27, 2008 discloses a mortise lock with a clutching function to allow free rotation of the outer handle when the lock is in a locked state. However, direct mounting of mortise locks on panic doors is not always readily achievable. Modification to mortise locks is required in most cases. Furthermore, mortise locks are relatively expensive than those more commonly utilized on panic doors with fewer functions.

A need exists for an inexpensive mortise lock that can be utilized with both an ordinary door and a panic door.

BRIEF SUMMARY OF THE INVENTION

The present invention solves this need and other problems in the field of door locks by providing, in a preferred form, a mortise lock including a case adapted to be mounted in a door. The case includes spaced first and second sidewalls having aligned first and second arcuate slots. A latch bolt is mounted in the case and includes a head movable between an extended, latching position outside the case and a retracted, unlatching position inside the case. The latch bolt further including a retractor mounted in the case and coupled to the head to move therewith. The retractor is movable between first and second positions corresponding to the extended, latching position and the retracted, unlatching position of the head. A key-operable cylinder is rotatably mounted to one of the first and second sidewalls and includes an actuating plate. A follower is pivotably mounted in the case and operably connected to and driven by the actuating plate. The follower is operably connected to the retractor such that pivotal movement of the follower in a first direction moves the retractor from the first position to the second position, moving the head of the latch bolt from the extended, latching position to the retracted, unlatching position. The follower further includes a first engaging hole in the most preferred form as a screw hole aligned with the first and second arcuate slots. A driving rod includes a first end pivotably mounted to one of the sidewalls and a second end coupled to the retractor such that pivotal movement of the driving rod in a second direction moves the retractor from the first position to the second position, moving the head of the latch bolt from the extended, latching position to the retracted, unlatching position. A hub is rotatably supported between the first and second sidewalls of the case. The hub includes spaced first and second lugs extending outward from an outer periphery thereof. The first lug is operably connected to the driving rod such that rotation of the hub causes pivotal movement of the driving rod. A locking plate is mounted in the case and movable between an upper, unlocking position allowing pivotal movement of the driving rod and a lower, locking position not allowing pivotal movement of the second lug of the driving rod and thus not allowing pivotal movement of the driving rod. A lever link is mounted in the case and between the first sidewall and the follower. The lever link includes a first end operably connected to the locking plate and a second end pivotably mounted to one of the first and second sidewalls of the case such that pivotal movement of the lever link causes vertical movement of the locking plate between the upper, unlocking position and the lower, locking position. The lever link further includes a second engaging hole aligned with the first and second arcuate slots and the first engaging hole. A connecting member in the most preferred form as a screw is selectively, removably, and slideably extended through to one of the first and second arcuate slots of the first and second sidewalls. When the connecting member is slideably extended through the first arcuate slot of the first sidewall, the connecting member is extended through the second engaging hole of the lever link into the first engaging hole of the follower, and the locking plate is movable between the upper, unlocking position and the lower, locking position by rotation of the cylinder through transmission by the lever link. On the other hand, when the connecting member is slideably extended through the second arcuate slot of the second sidewall, the connecting member is engaged in the first engaging hole of the follower and not engaged in the second engaging hole of the lever link such that the lever link is not pivoted and the locking plate is not moved when the cylinder is rotated.

In the most preferred form, the first sidewall includes first and second pivots and a pin formed on an inner face thereof. The second end of the lever link is pivotably mounted to the first pivot. The follower includes first and second ends and an intermediate portion having the screw hole. The intermediate portion of the follower is pivotably mounted to the first pivot. The first end of the follower is operably connected to the actuating plate such that rotation of the cylinder causes pivotal movement of the follower about a first pivot axis formed by the first pivot. The second end of the follower is operably coupled to the retractor such that pivotal movement of the follower in the first direction moves the retractor from the first position to the second position. The hub further includes a third lug extending outward from the outer periphery thereof and spaced from the first and second lugs. The first end of the driving rod is pivotably mounted to the second pivot. A link includes a first end pivotably mounted to the second pivot, a second end, and an intermediate portion operably connected to the driving rod. A thumb piece is operably connected to the second end of the link. The link pivots about a second pivot axis formed by the second pivot when thumb piece is manually operated, urging the driving rod to pivot about the second pivot axis and moving the retractor from the first position to the second position. The locking plate includes an upper end and a lower end spaced from the upper end in a vertical direction perpendicular to a moving direction of the retractor. The locking plate further includes a guide slot between the upper and lower ends and extending in a horizontal direction parallel to the moving direction of the retractor. The first end of the lever link includes a peg slideably engaged in the guide slot such that pivotal movement of the lever link causes movement of the locking plate between the upper, unlocking position and the lower, locking position. The lower end of the locking plate is U-shaped and includes spaced, parallel first and second side plates and an intermediate plate interconnected between the first and second side plates. The first and second side plates include aligned vertical slots slideably receiving the pin on the inner face of the first sidewall, allowing and guiding movement of the locking plate in the vertical direction between the upper, unlocking position and the lower, locking position. The intermediate plate of the locking plate has a length slightly smaller than a spacing between the first and second sidewalls. The upper end of the locking plate includes a bend extending in a direction perpendicular to the horizontal and vertical directions and between the sidewalls. The bend has a length slightly smaller than the spacing between the first and second sidewalls. The locking plate further includes an ear. The first sidewall further includes a groove extending in the vertical direction and spaced from the pin in the vertical direction. A resilient plate is mounted in the groove and includes a protruded portion abutting at one of upper and lower sides of the ear of the locking plate. The ear is movable between an upper position at an upper side of the protruded portion of the resilient plate corresponding to the upper, unlocking position of the locking plate and a lower position at a lower side of the protruded portion of the resilient plate corresponding to the lower, locking position of the locking plate, with the protruded portion retaining the locking plate in one of the upper, unlocking position and the lower, locking position.

The hub can further include a spindle hole, and the mortise lock can further include a lever handle having a spindle securely coupled in the spindle hole. The hub is rotated when the lever handle is rotated, with the first lug urging the driving rod to pivot about the second pivot axis and moving the retractor from the first position to the second position.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
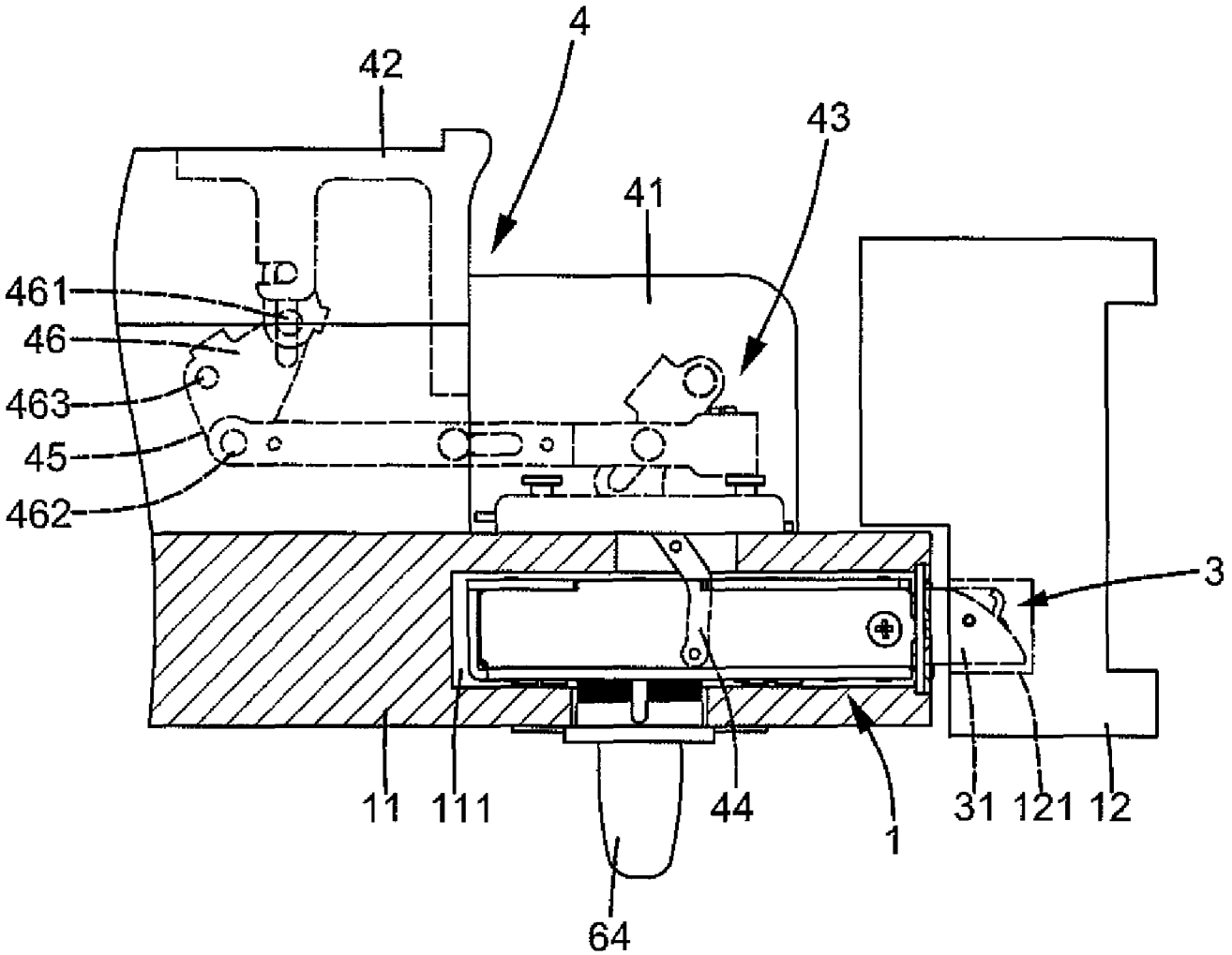
FIG. 1 shows a partial, cross-sectional view of a door and a mortise lock according to the preferred teachings of the present invention.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "lower", "upper", "end", "portion", "section", "horizontal", "vertical", "annular", "outward", "spacing", "clockwise", "counterclockwise", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A mortise lock according to the preferred teachings of the present invention is shown in the drawings and generally designated 1. According to the preferred form shown, mortise lock 1 is mounted in a compartment 111 in an edge of a door 11. Mortise lock 1 includes a substantially parallelepiped-shaped case 2 including an outer end face 21. A faceplate 22 is mounted to outer end face 21 and forms a part of case 2. Faceplate 22 includes first and second openings 221 and 222 spaced in a vertical direction. Case 2 further includes two sidewalls 23 and 24 spaced in a direction perpendicular to the vertical direction. According to the most preferred form shown, sidewall 24 is in the form of a lid removably mounted by screws 29 to a side of case 2 opposite to sidewall 23. Sidewalls 23 and 24 include aligned cylinder holes 231 and 241 in upper portions thereof, aligned slots 232 and 242 in intermediate portions thereof, and aligned notches 233 and 243 in lower ends thereof Slots 232 and 242 extend in a horizontal direction perpendicular to the vertical direction. Sidewalls 23 and 24 further include aligned arcuate slots 234 and 244 each having upper and lower ends spaced in the vertical direction. Arcuate slot 234 is located between cylinder hole 231 and slot 232. Arcuate slot 244 is located between cylinder hole 241 and slot 242 and longer than arcuate slot 234. Sidewalls 23 and 24 further includes aligned positioning holes 235 and 245 each of which is between and spaced from one of arcuate slots 234 and 244 and one of slots 232 and 242. Furthermore, sidewalls 23 and 24 includes aligned positioning holes 238 and 248 spaced from slot 232, 242 and notch 233, 243 in the vertical direction. Further, sidewalls 23 and 24 include aligned hub holes 236 and 246 each of which is between one of slots 232 and 242 and one of notches 233 and 243. Further, sidewall 23 includes three pivots 25, 26, and 28 and a pin 27 formed on an inner face thereof and spaced from one another. Further, sidewall 23 includes a groove 237 formed in the inner face thereof and adjacent to pivot 25 and spaced from pin 27 in the vertical direction.

Figure 4:
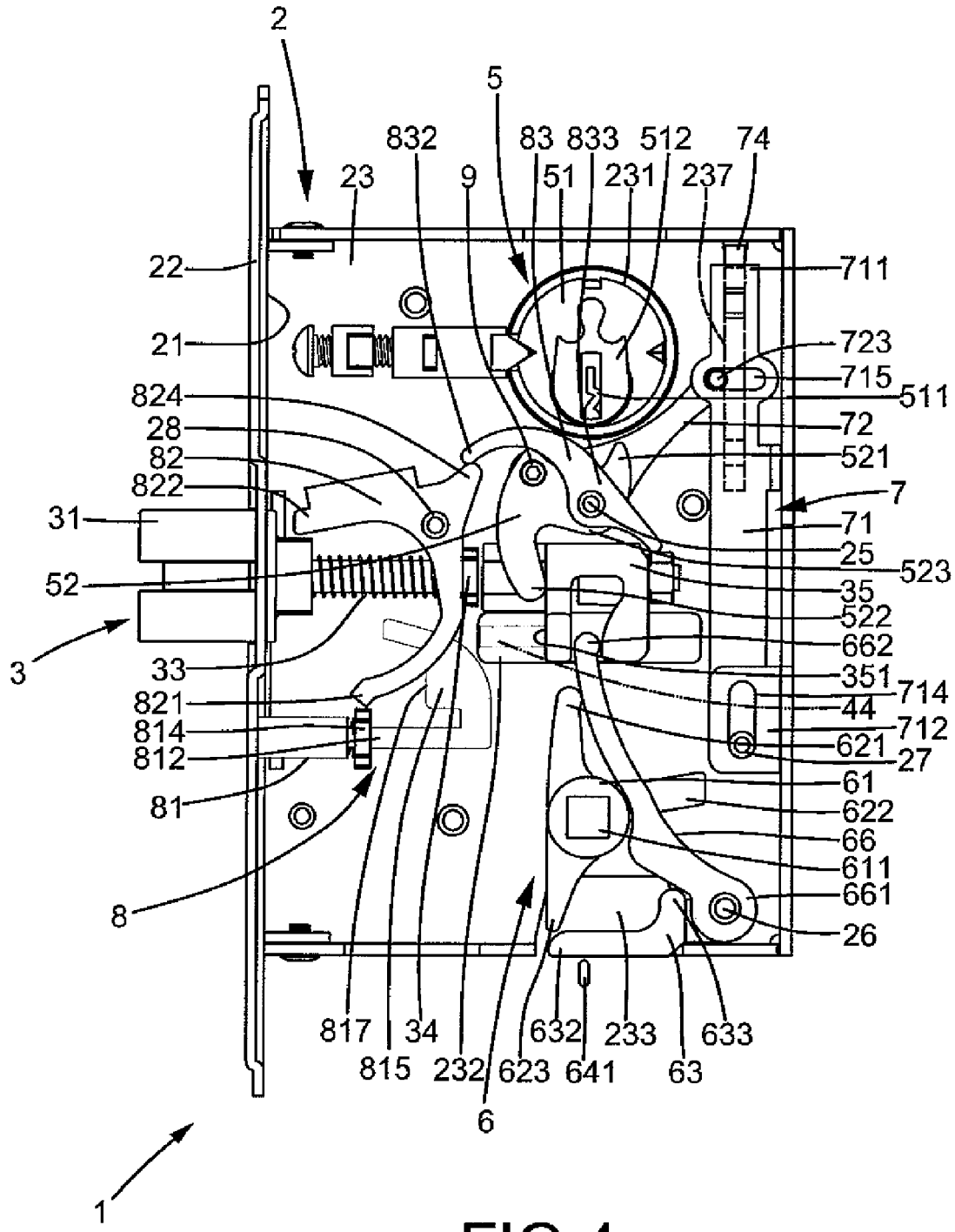
FIG. 4 shows a side view of the mortise lock of FIG. 1 with a sidewall of a case of the mortise lock removed, with an auxiliary bolt in a retracted position, and with a connecting member extended through the sidewall.
Figure 5:
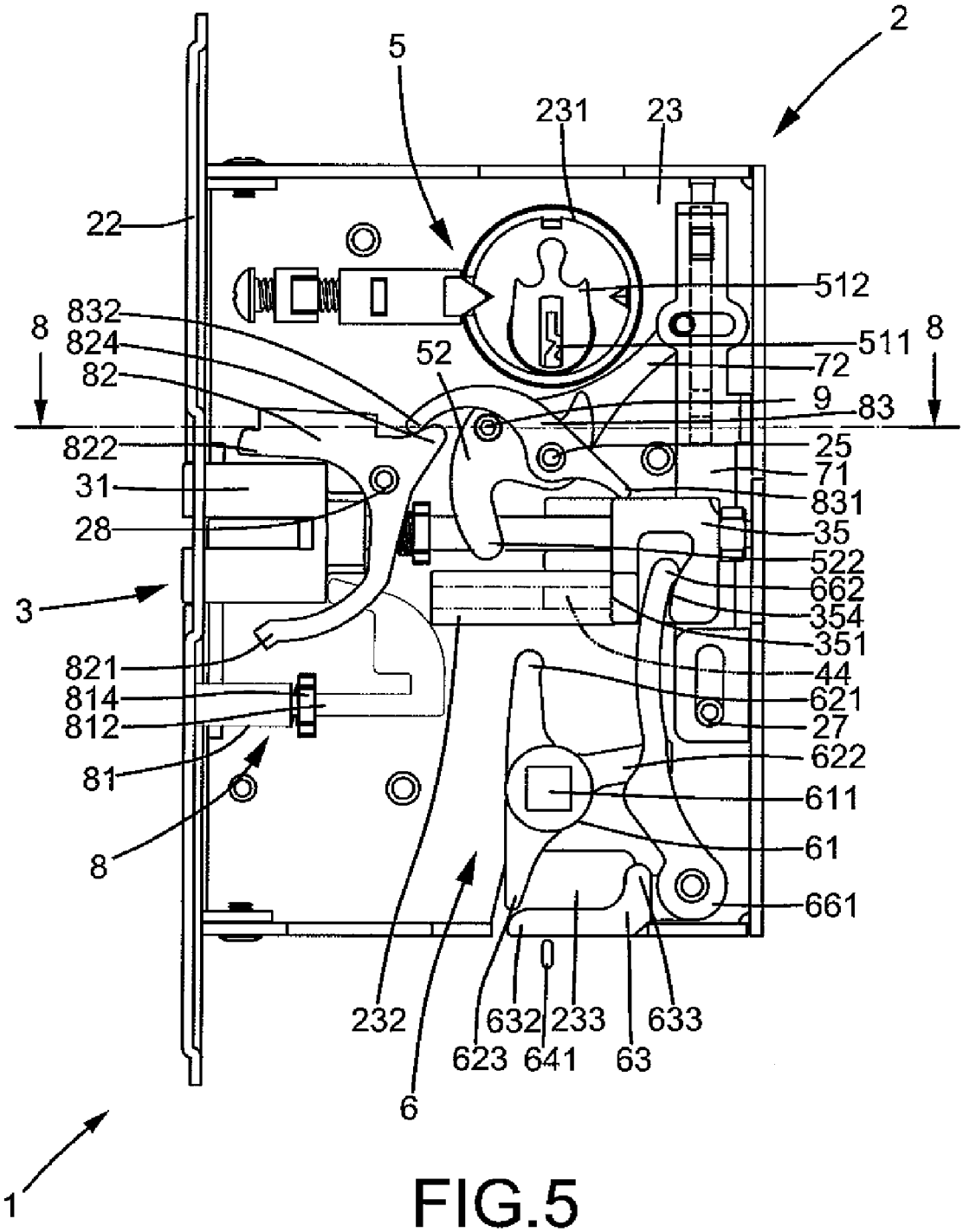
FIG. 5 shows a side view of the mortise lock of FIG. 1 with the sidewall removed, with the auxiliary bolt and a latch bolt in retracted positions.

According to the preferred form shown, mortise lock 1 further includes a latch bolt 3 having a head 31 with substantially triangular cross sections and a shank 32 extending from head 31 in the horizontal direction. A positioning plate 34 is mounted around shank 32 and includes two protrusions 341 engaged in positioning holes 235 and 245 of sidewalls 23 and 24. Positioning plate 34 includes a through-hole slideably receiving shank 32. A spring 33 is mounted between positioning plate 34 and head 33 and around shank 32. A retractor 35 is mounted on shank 32 to move therewith and spaced from spring 33 by positioning plate 34. Retractor 35 includes an abutting face 351 facing head 31 and two sidewalls 353 each having a protrusion 352 slideably received in one of slots 232 and 242. Thus, retractor 35 is slideable in the horizontal direction between first and second positions to cause movement of shank 32 and head 31 in the same direction, allowing movement of head 31 through first opening 221 between an extended, latching position outside case 2 (FIG. 4) and a retracted, unlatching position inside case 2 (FIG. 5). Note that head 31 is engaged in a groove 121 in a door frame 12 when door 11 is closed (FIG. 1). Retractor 35 further includes a notch 354 in one of sidewalls 353 thereof.

According to the preferred form shown, an inner operating device 4 is mounted to a side of door 11 and includes a linking mechanism 45 and a driving mechanism 43. Linking mechanism 45 can be of any desired form as conventional including but not limited to of a commercially available type. According to the preferred form shown, linking mechanism 45 includes a housing 41 and an operative member 42 in the most preferred form shown as a press bar pivotably coupled to housing 41. A rocker 46 is pivotably mounted in housing 41 and includes a first corner 461 pivotably connected to operative member 42, a second corner 462 pivotably connected to driving mechanism 43, and a third corner 463 pivotably connected to housing 41. Driving mechanism 43 includes a draw member 44 extending through slot 242 and having an end abutting against abutting face 351 of retractor 35 (see FIG. 4). When operative member 42 is operated (e.g., pressed), rocker 46 pivots about third corner 463 to driving draw member 44 of driving mechanism 43 to retract head 31 of latch bolt 3 to the retracted, unlatching position (FIG. 5). It can be appreciated that driving mechanism 43 can be of any desired form as conventional including but not limited to of a commercially available type. An example of linking mechanism 45 and driving mechanism 43 is disclosed in U.S. patent application Ser. No. 12/109,395 filed Apr. 25, 2008, the entire contents of which are incorporated herein by reference.

According to the preferred form shown, mortise lock 1 further includes a key-operated mechanism 5 having a cylinder 51 mounted in cylinder hole 231 of sidewall 23. Cylinder 51 includes a keyway 511 and an actuating plate 512 that is rotated when a key is inserted into keyway 511 and rotated. A follower 52 is mounted in case 2 and includes first and second ends 521 and 522 and an intermediate portion 523 between first and second ends 521 and 522. First end 521 of follower 52 is located in a rotating path of actuating plate 512. Second end 522 of follower 52 abuts abutting face 351 of retractor 35 when head 31 of latch bolt 3 is in the extended, latching position (see FIG. 4). Intermediate portion 523 of follower 52 further includes an engaging hole 524 in the most preferred form shown as a screw hole. When actuating plate 512 rotates clockwise due to rotation of a key inserted into keyway 511, follower 52 pivots counterclockwise about a pivot axis formed by pivot 25 and pushes retractor 35 away from first opening 221 to the second position, moving head 31 of latch bolt 3 to the retracted, unlatching position (see FIGS. 6 and 7).

Figure 6:
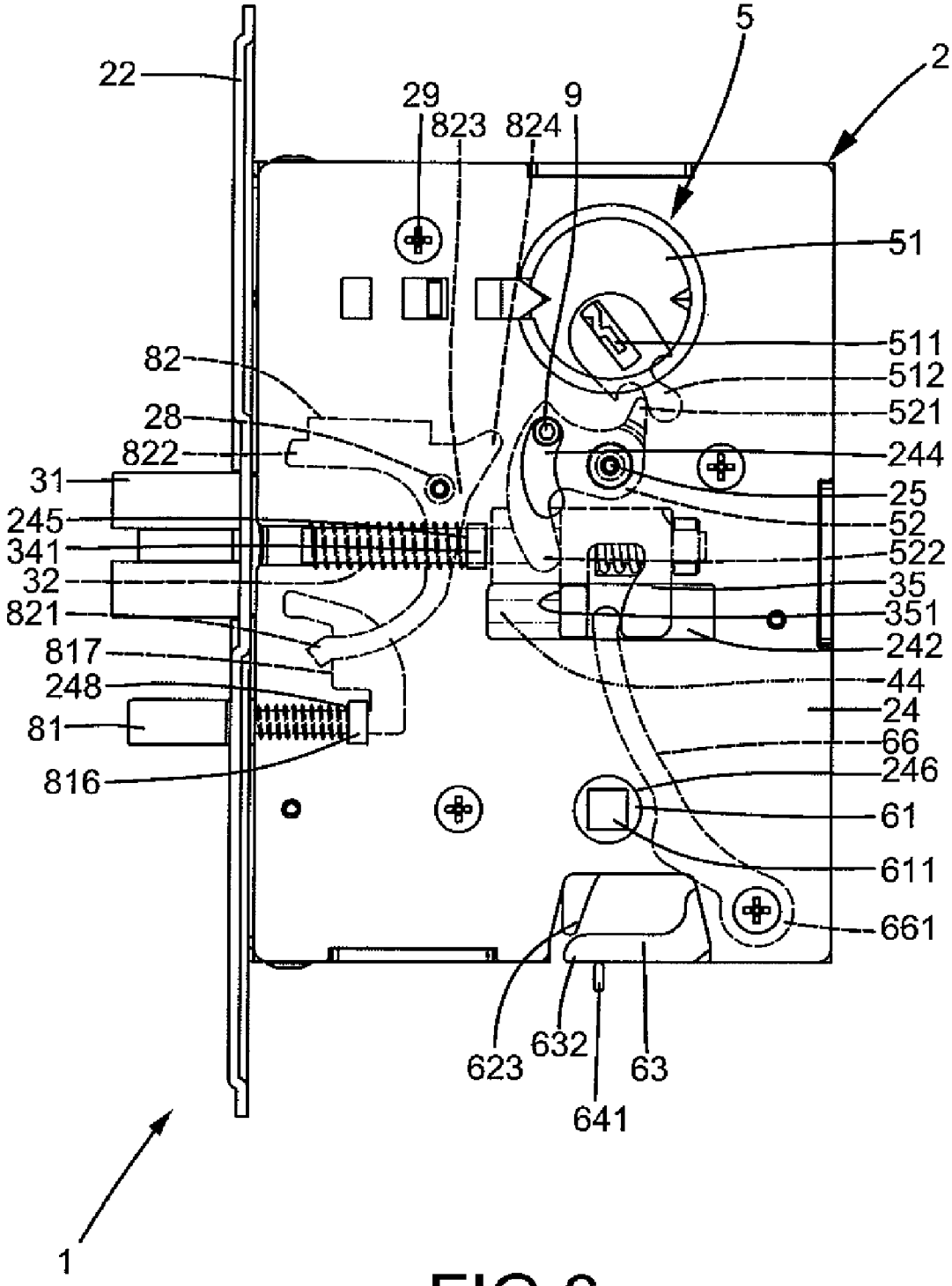
FIG. 6 shows a side view of the mortise lock of FIG. 1 with an actuating plate rotated clockwise through an angle and with the auxiliary bolt and the latch bolt in extended positions.
Figure 7:
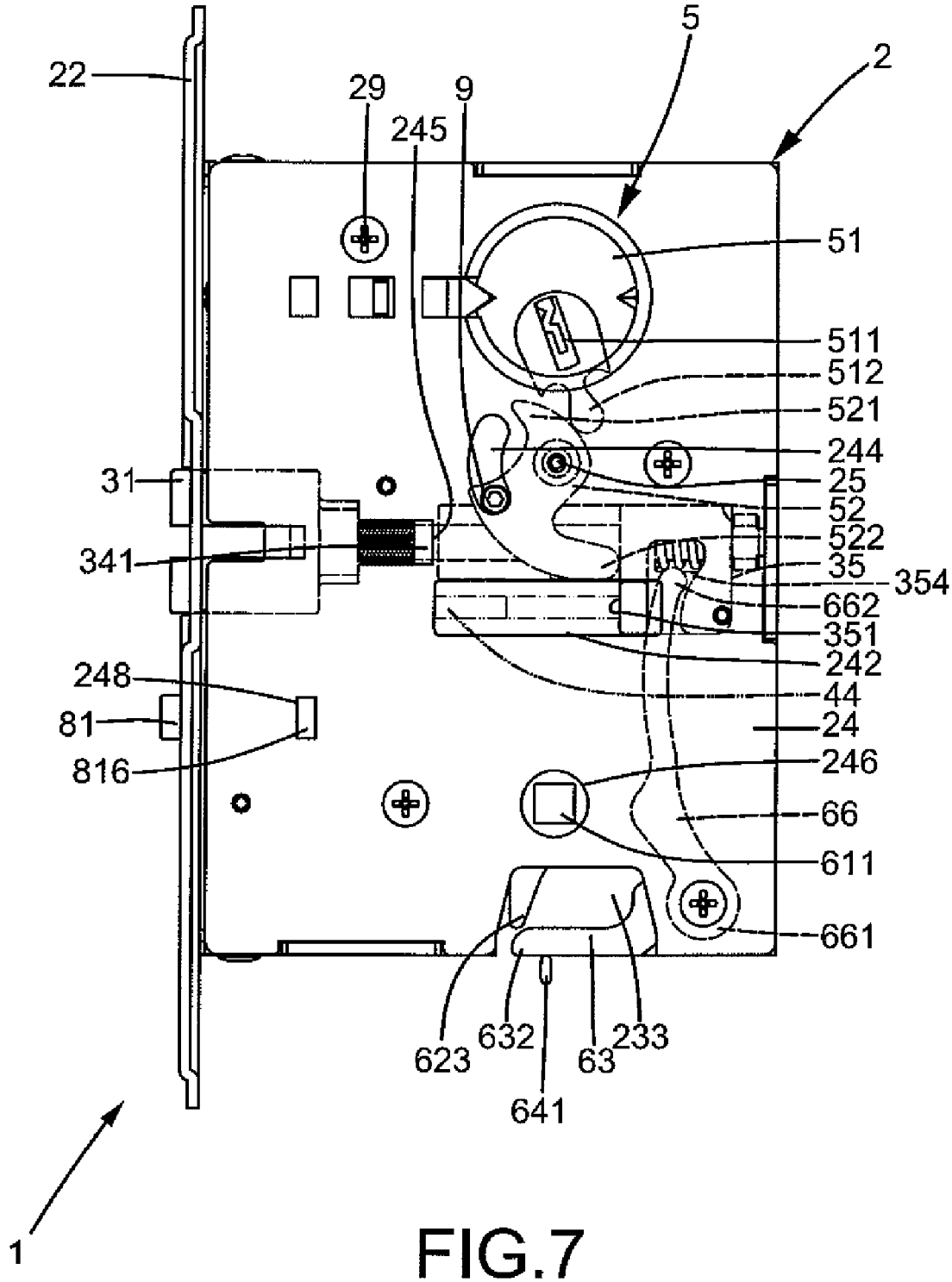
FIG. 7 shows a side view of the mortise lock of FIG. 6 with the latch bolt retracted due to further clockwise rotation of the actuating plate.
Figure 8:
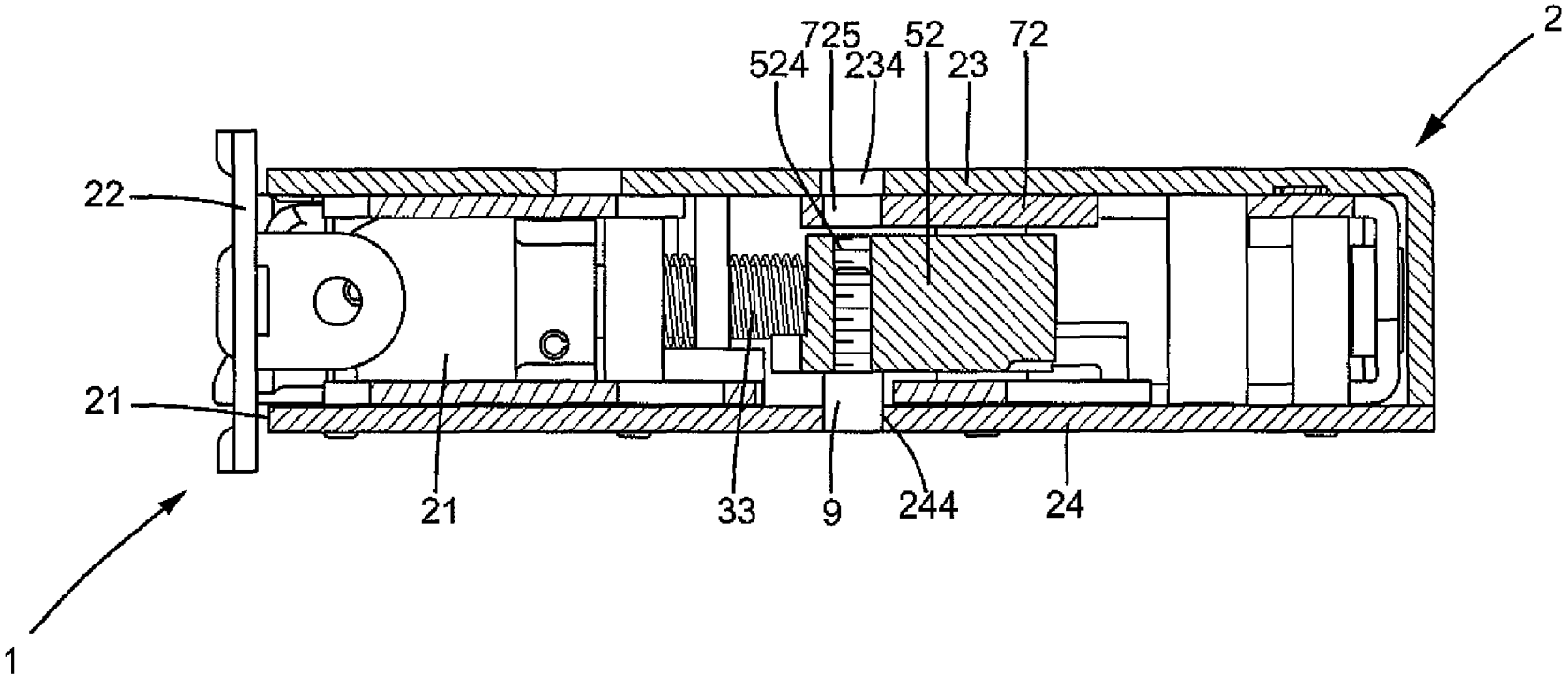
FIG. 8 shows a cross-sectional view of the mortise lock of FIG. 1 according to section line 8-8 of FIG. 5.

According to the preferred form shown, a connecting member 9 in the most preferred form shown as a screw is extended through arcuate slot 244 of sidewall 24 into engaging hole 524 of follower 52 (FIG. 8). Connecting member 9 is located in the upper end of arcuate slot 244 when follower 52 is in its original position in which retractor 35 is in the first position and head 31 is in the extended, latching position (FIG. 6). Note that clockwise movement of follower 52 is stopped by connecting member 9. Counterclockwise movement of follower 52 is stopped when connecting member 9 reaches a lower end of arcuate slot 244 (FIG. 7).

According to the preferred form shown, mortise lock 1 further includes an outer operating device 6 including a hub 61 mounted in case 2. Hub 61 includes a spindle hole 611 having square cross sections and two ends 612 rotatably received in hub holes 236 and 246 of sidewalls 23 and 24. Annularly spaced first, second, and third lugs 621, 622, and 623 extend outward from an outer periphery of hub 61, with first lug 621 below retractor 35, with second lug 622 intermediate pivot 26 and pin 27, and with third lug 623 adjacent to notches 233 and 243.

According to the preferred form shown, outer operating device 6 further includes a driving rod 66 mounted in case 2. Driving rod 66 includes a first end 661 pivotably mounted on pivot 26 and a second end 662 received in notch 354 of retractor 35. Driving rod 66 abuts against first lug 621 of hub 61 at a position adjacent to and below second end 662.

According to the preferred form shown, outer operating device 6 further includes a link 63 having a first end 631 pivotably mounted on pivot 26, a second end 632 adjacent to notches 233 and 243, and an intermediate portion 633 in the most preferred form shown having a protruded portion adjacent to first end 661 of driving rod 66.

Figure 2:
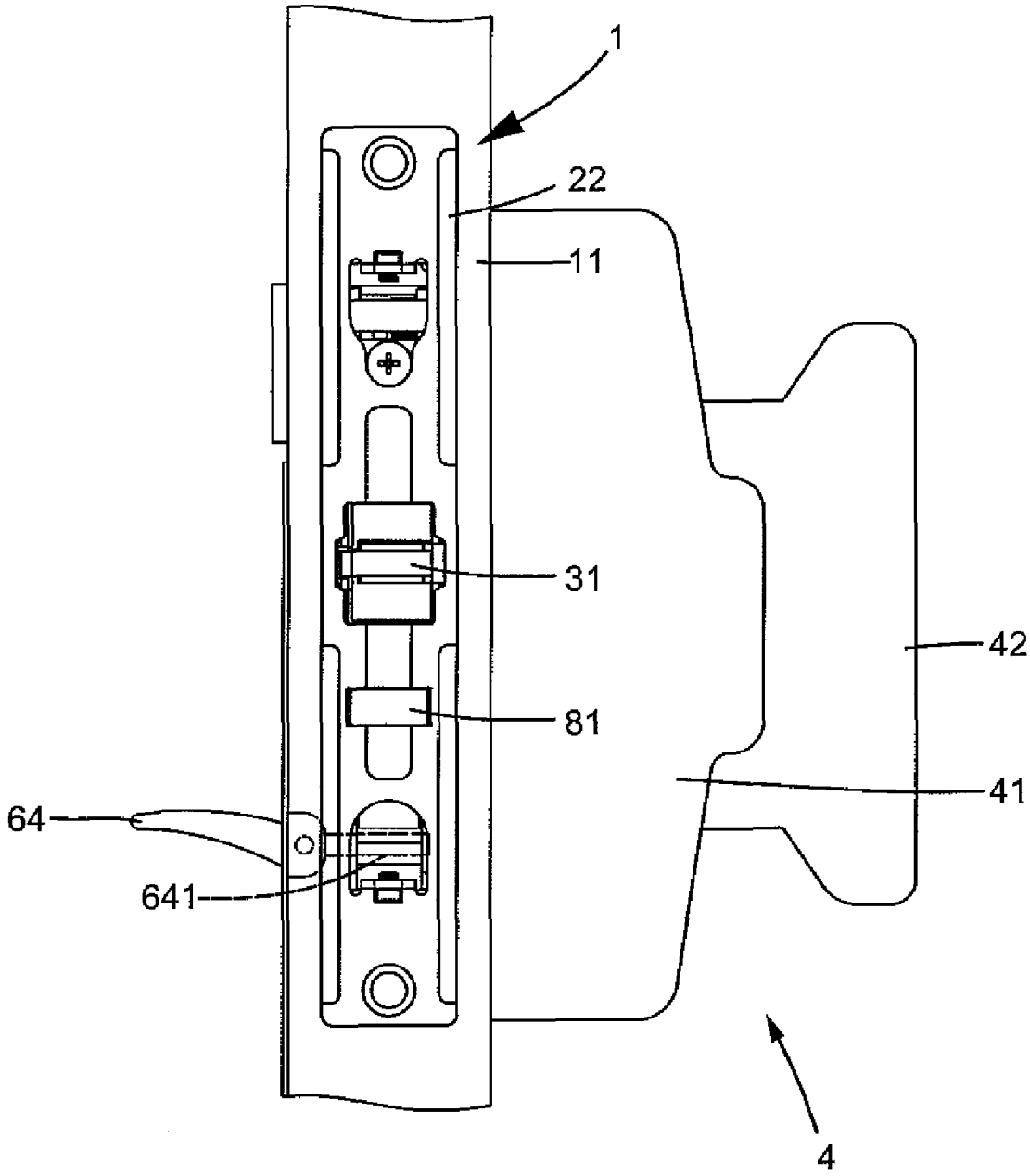
FIG. 2 shows an elevational view of the door and the mortise lock of FIG. 1.
Figure 3:
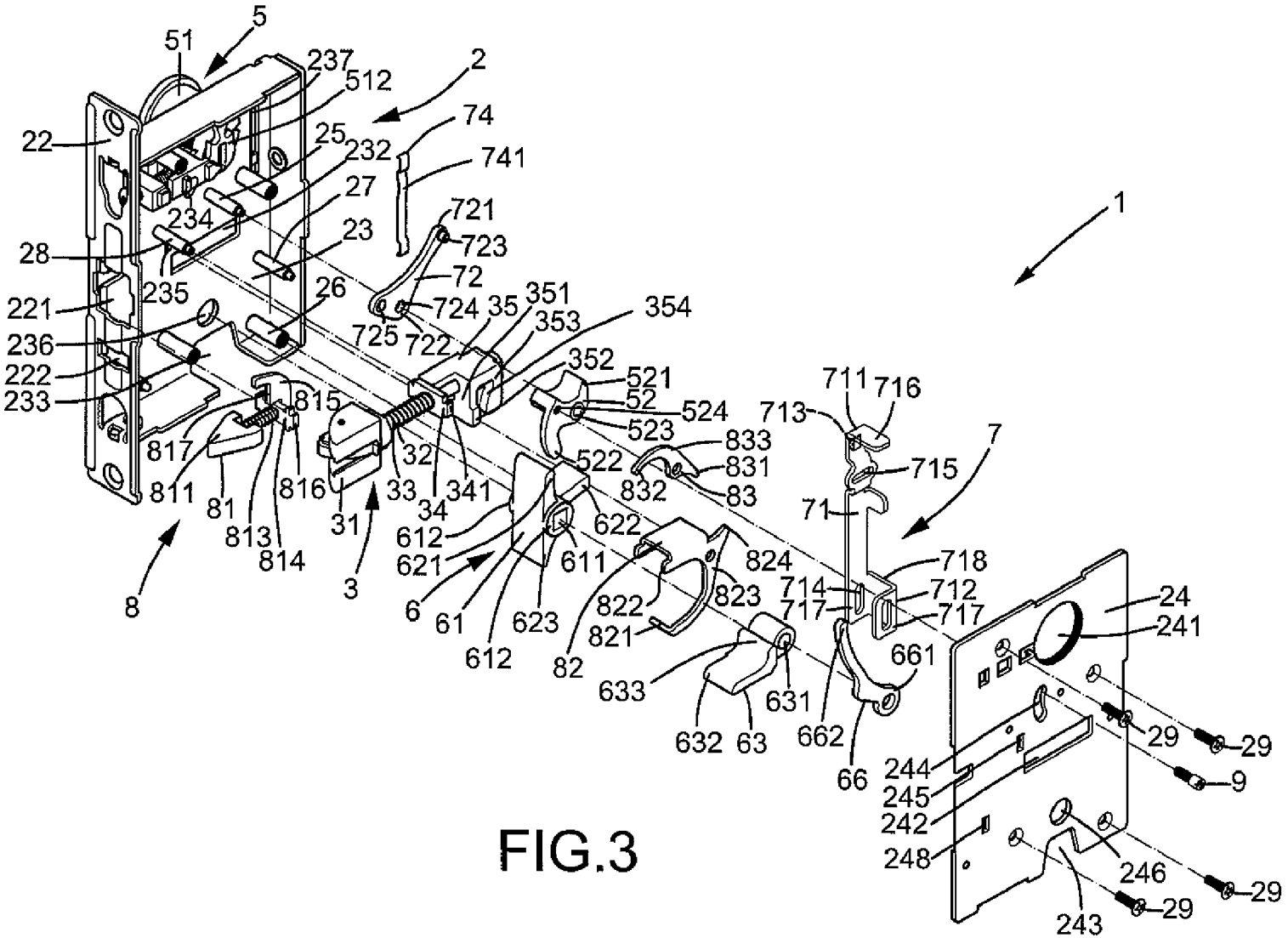
FIG. 3 shows an exploded, perspective view of the mortise lock of FIG. 1.
Figure 9:
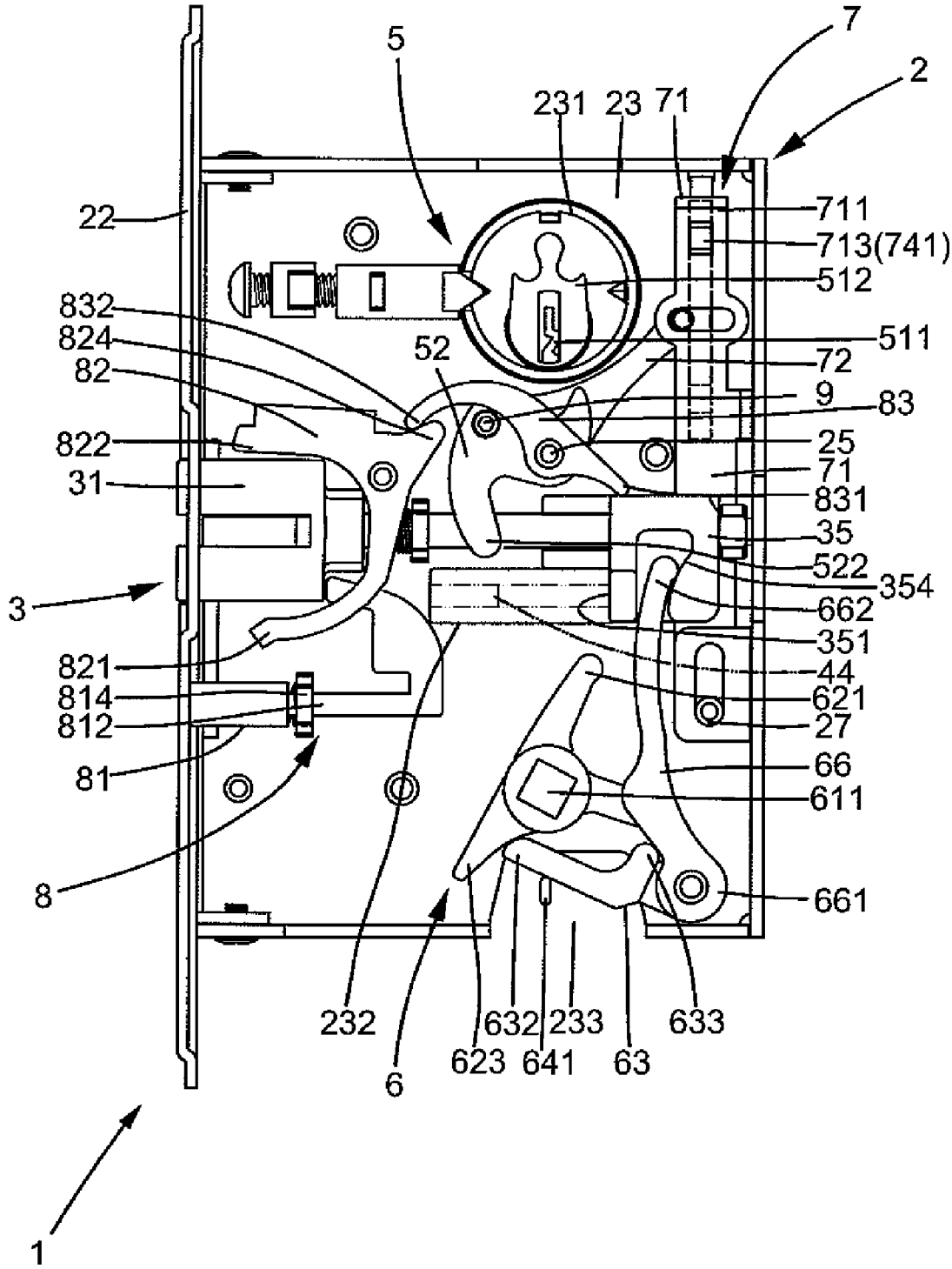
FIG. 9 shows a side view of the mortise lock of FIG. 1 with a thumb piece rotated to retract the latch bolt.

According to the preferred form shown, outer operating device 6 further includes a thumb piece 64 mounted to the other side of door 11 and outside case 2. Thumb piece 64 includes an actuator 641 below second end 632 of link 63 (FIGS. 2 and 4). When thumb piece 64 is pressed downward, actuator 641 is moved through notch 243 of sidewall 24 to move link 63 upward, which in turn, urges driving rod 66 to pivot about a pivot axis formed by pin 26. Thus, head 31 of latch bolt 3 is moved to the retracted, unlatching position (FIG. 9).

Figure 13:
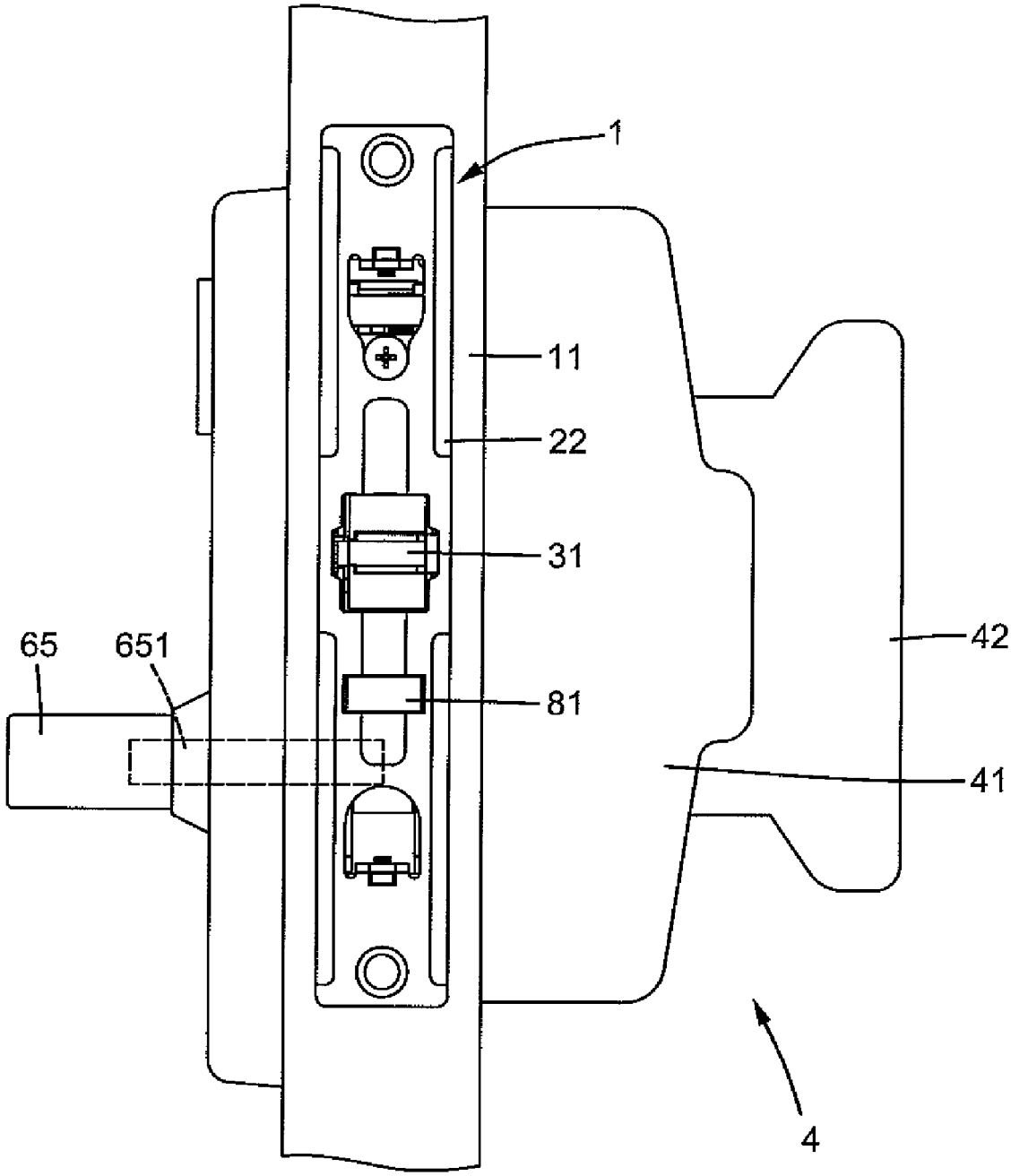
FIG. 13 shows an elevational view of the door and the mortise lock of FIG. 2 with the thumb piece of the mortise lock of FIG. 2 replaced with a lever handle.
Figure 14:
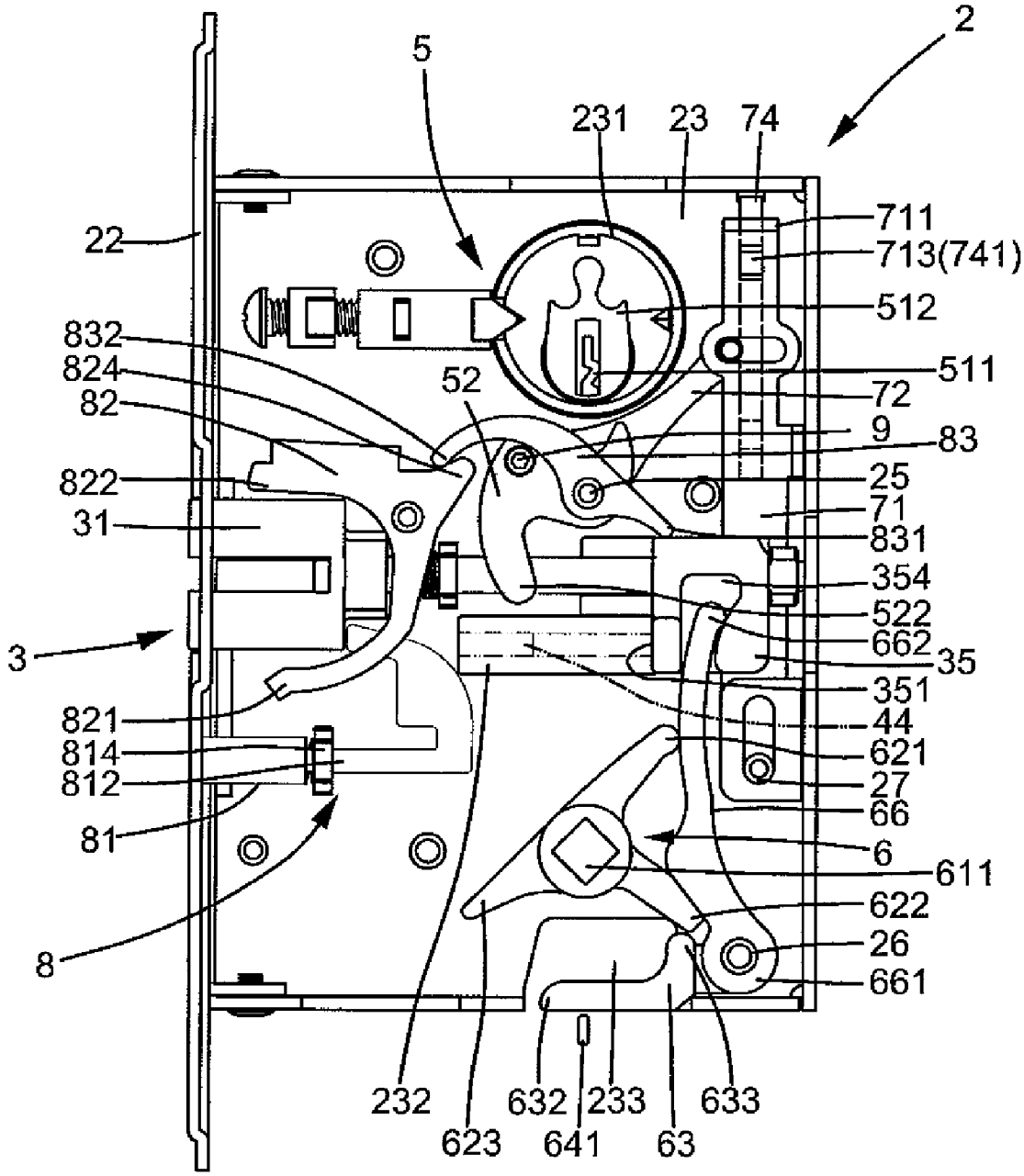
FIG. 14 shows a side view of the mortise lock of FIG. 13 with the lever handle rotated to retract the latch bolt.

With reference to FIG. 13, thumb piece 64 can be replaced with a lever handle 65 axis formed by pin 26, moving head 31 of latch bolt 3 to the retracted, unlatching position (FIG. 14).

According to the preferred form shown, mortise lock 1 further includes a locking device 7 having a locking plate 71 and a lever link 72. Locking plate 71 extends in the vertical direction and includes upper and lower ends 711 and 712 spaced in the vertical direction. Upper end 711 includes a bend 716 extending in a direction perpendicular to the horizontal and vertical directions and between sidewalls 23 and 24. Bend 716 has a length slightly smaller than a spacing between sidewalls 23 and 24. Lower end 712 is substantially U-shaped and includes spaced, parallel first and second side plates 717 having aligned vertical slots 714 and an intermediate plate 718 interconnected between first and second side plates 717. Intermediate plate 718 has a length slightly smaller than the spacing between sidewalls 23 and 24. Pin 27 is extended through vertical slots 714, allowing and guiding movement of locking plate 71 in the vertical direction between an upper, unlocking position and a lower, locking position. Upward and downward movement of locking plate 71 is limited by upper and lower ends of vertical slots 714. Locking plate 71 further includes an ear 713 on a face thereof facing sidewall 23. Locking plate 71 further includes a guide slot 715 between upper and lower ends 711 and 712 and extending in the horizontal direction (i.e., the moving direction of latch bolt 3).

According to the preferred form shown, lever link 72 is mounted between sidewall 23 and follower 52 and includes first and second ends 721 and 722. According to the most preferred form shown, first end 721 of lever link 72 includes a peg 723 slideably received in guide slot 715 of locking plate 71. Second end 722 of lever link 72 has a through-hole 724 extended through by pivot 25. Thus, lever link 72 can about a pivot axis formed by pivot 25 to move locking plate 71 between the upper, unlocking position and the lower, locking position. Second end 722 of lever link 72 further includes an engaging hole 725 spaced from through-hole 724 and aligned with arcuate slots 233 and 234 of sidewalls 23 and 24 and engaging hole 524 of follower 52.

According to the preferred form shown, a resilient plate 74 is mounted in groove 237 of sidewall 23 and includes a protruded portion 741 abutting at a side of ear 713. When locking plate 71 moves upward to the upper, unlocking position, ear 713 moves from a lower position at a lower side of protruded portion 741 to an upper position at an upper side of protruded portion 741, pressing against protruded portion 741 to retain locking plate 71 in place. On the other hand, when locking plate 71 moved downward to the lower locking position, ear 713 moves from the upper position to the lower position at the lower side of protruded portion 741, pressing against protruded portion 741 to retain locking plate 71 in place. Namely, ear 713 moves between the upper and lower positions relative to protruded portion 741 when locking plate 71 moves in the vertical direction with ear 713 in either position pressing against protruded portion 741 to retain locking plate 71 in place by resiliency of resilient plate 74. Although resiliency of resilient plate 74 will move ear 713 away from protruded portion 741, the bend 716 slightly shorter than the spacing between the sidewalls 23 and 24 will come in contact with sidewall 24 and stop movement of ear 713 away from protruded portion 741. As a result, ear 713 reliably presses against protruded portion 741 of resilient plate 74 and, thus, reliably retains locking plate 71 in place.

According to the preferred form shown, mortise lock 1 further includes an auxiliary locking device 8 having an auxiliary bolt 81, a stop 82, and an unlocking lever 83. Auxiliary bolt 81 includes an auxiliary bolt head 811 having substantially triangular cross sections and a shank 812 extending from head 811. A positioning plate 814 is mounted around shank 812 and includes two projections 816 engaged in positioning holes 238 and 248 of sidewalls 23 and 24. Positioning plate 814 includes a through-hole slideably receiving shank 812. A spring 813 is mounted between positioning plate 814 and head 813 and around shank 812. A driven plate 815 is securely mounted on shank 812 to move therewith and includes a substantially C-shaped abutting face 817 facing auxiliary bolt head 811. When door 11 is closed, auxiliary bolt head 811 is moved to a retracted position (FIG. 4). When door 11 is open, auxiliary bolt head 811 is biased by spring 813 out of case 2 to an extended position via second opening 222 (FIG. 6).

According to the preferred form shown, stop 82 includes first and second ends 821 and 822 and an intermediate portion 83 pivotably mounted to pivot 28. First end 821 of stop 82 is substantially L-shaped in cross section, and second end 822 of stop 82 is substantially U-shaped in cross section. A protrusion 824 extends outward from intermediate portion 823. First end 821 of stop 82 is located in a moving path of driven plate 815. When auxiliary bolt head 811 moves outward (FIG. 6), abutting face 817 of driven plate 815 comes in contact with and lifts second end 822 of stop 82 (i.e., stop 82 pivots clockwise) to a position not hindering retraction of latch bolt 3. On the other head, auxiliary bolt head 811 moves to the retracted position when door 11 is closed (FIG. 4). Driven plate 815 is moved away from faceplate 22 under the action of spring 813 and, thus, disengages from first end 821 of stop 82. Stop 82 pivots downward under the action of gravitational force such that second end 822 of stop 82 moves to a position in a retraction path of head 31 of latch bolt 3, preventing retraction of head 31 even picked by a burglar.

According to the preferred form shown, unlocking lever 83 is mounted in case 2 and includes first and second ends 831 and 832 and an intermediate section 833 pivotably mounted to pivot 25. First end 831 of unlocking lever 83 is located in a retraction path of retractor 35 such that unlocking lever 83 pivots counterclockwise about the pivot axis formed by pivot 25 when retractor 35 comes in contact with and actuates unlocking lever 83 during retraction of retractor 35 (FIG. 5). Second end 832 of unlocking lever 83 engages with protrusion 824 of stop 82. Counterclockwise pivotal movement of unlocking lever 83 causes clockwise pivotal movement of stop 82 about the pivot axis formed by pivot 28 to a position not hindering retraction of latch bolt 3 (FIG. 5).

With reference to FIGS. 6 and 8, when connecting member 9 is extended through arcuate slot 244 of sidewall 24 into engaging hole 524, connecting member 9 will not extend into engaging hole 725 of lever link 72, for connecting member 9 has a length smaller than a spacing between sidewall 24 and lever link 72. Thus, lever link 72 is not rotated when follower 52 rotates. As a result, locking plate 71 is not moved. Namely, locking device 7 is inactive, and locking plate 71 is in its upper, unlocking position. In this case, when door 11 is closed (FIG. 4), head 31 of latch bolt 3 can be moved to the retracted, unlatching position by operating operative member 42 to move draw member 44, or utilizing a key to rotate actuating plate 512, or operating thumb piece 64 (or lever handle 65) (see FIGS. 5, 7, 9, 14). Note that clockwise movement of connecting member 9 is stopped by arcuate slot 244 (FIG. 6).

Figure 10:
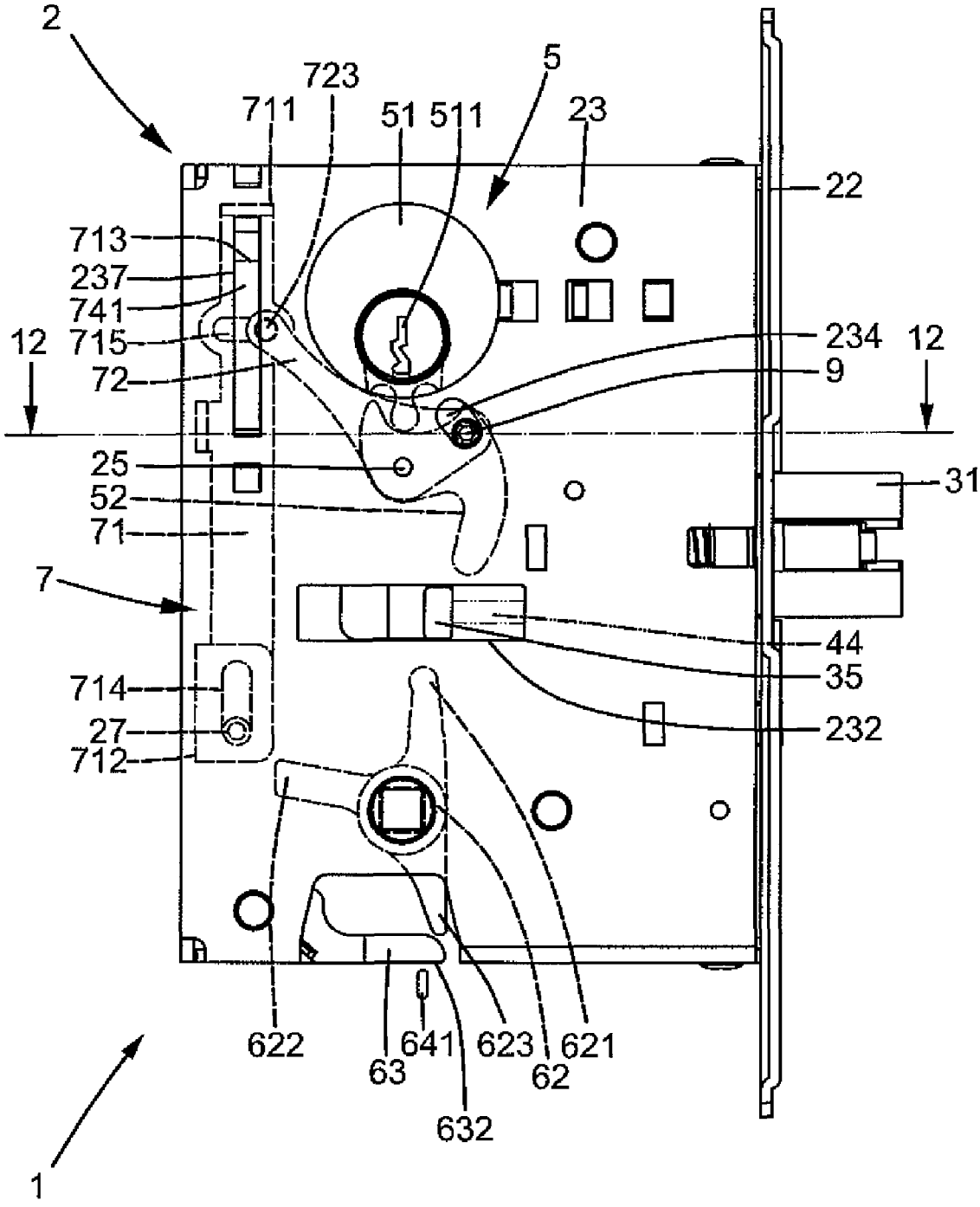
FIG. 10 shows another side view of the mortise lock of FIG. 1 with the connecting member extended through the other sidewall of the case of the mortise lock and with the actuating plate rotated through an angle.
Figure 11:
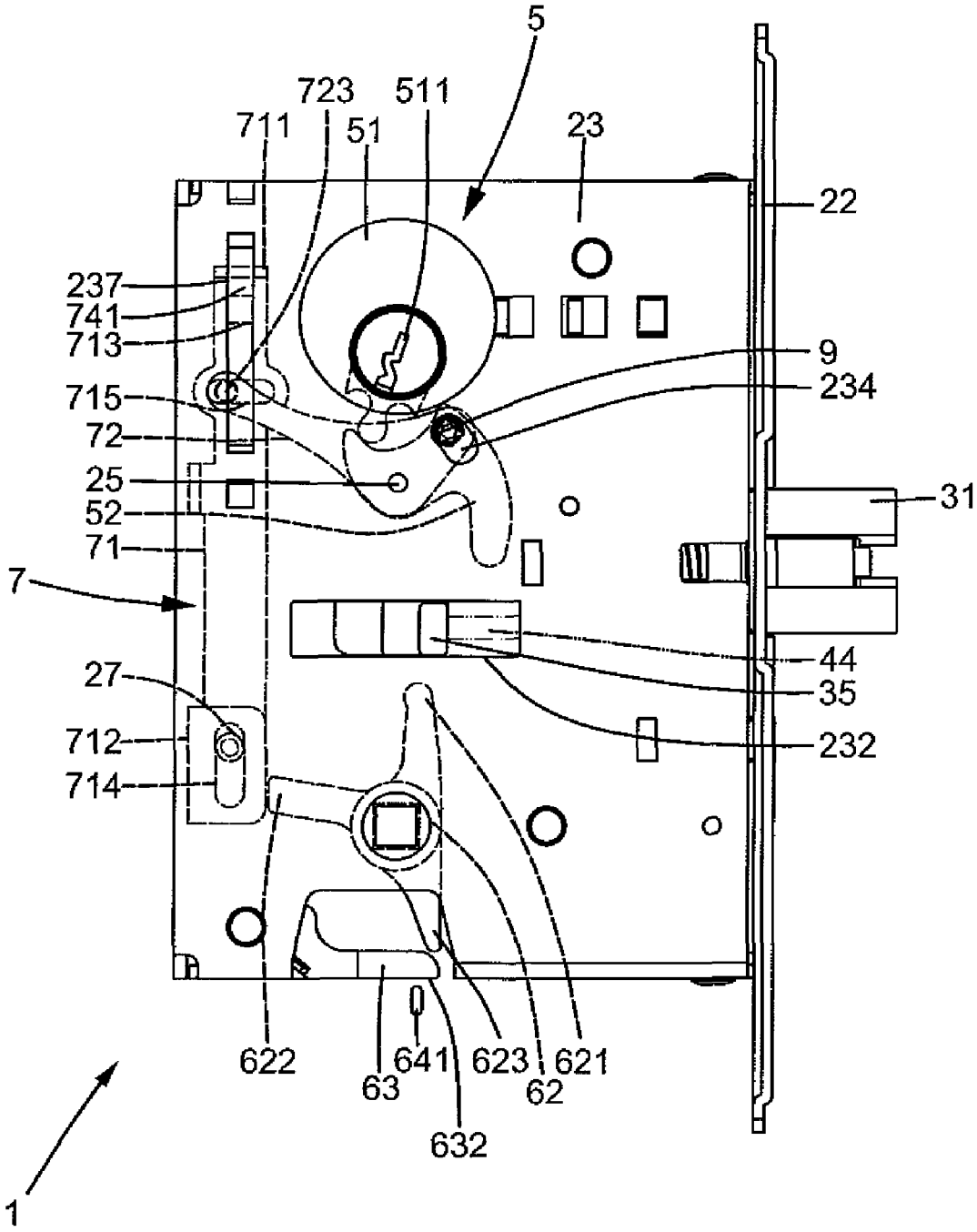
FIG. 11 shows a side view of the mortise lock of FIG. 10 with the latch bolt retracted due to further rotation of the actuating plate.
Figure 12:
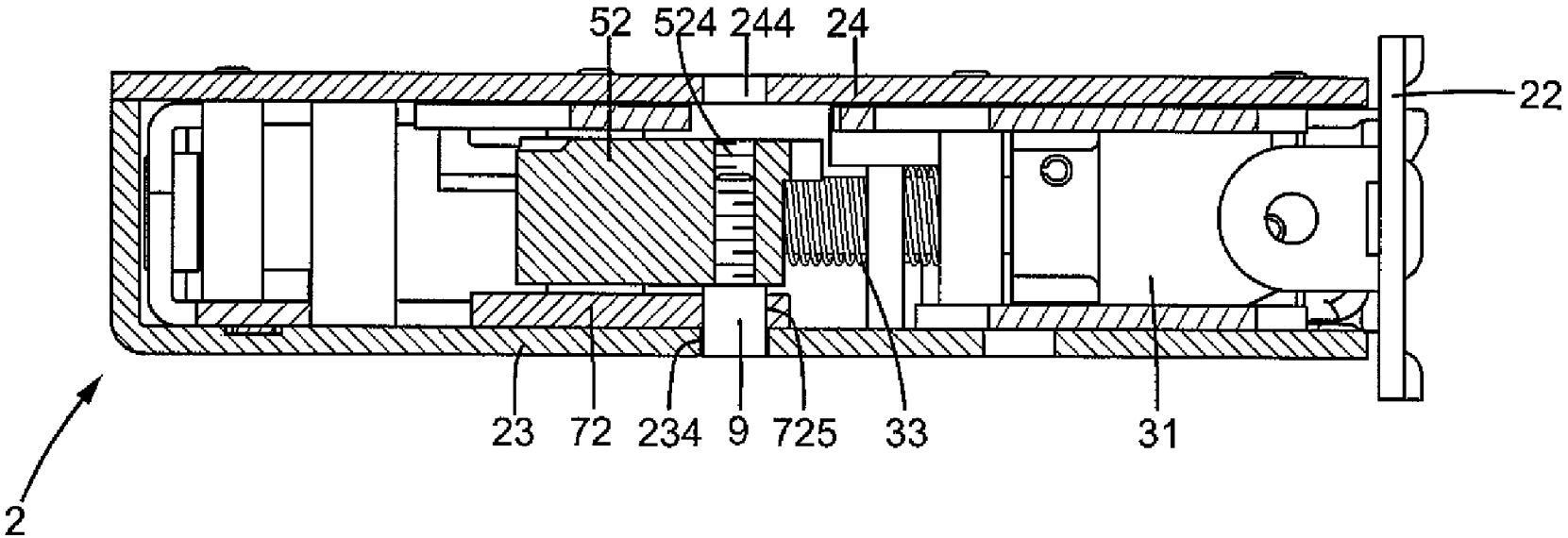
FIG. 12 shows a cross-sectional view of the mortise lock of FIG. 10 according to section line 12-12 of FIG. 10.

On the other hand, connecting member 9 can be mounted through arcuate slot 234 of sidewall 23 into engaging hole 524 of follower 52 so that locking device 7 becomes active and provides locking functions (FIG. 12). Specifically, when door 11 is closed and when a key is utilized to drive actuating plate 512, follower 52 rotates and causes pivotal movement of lever link 72 (see FIGS. 10 and 11) about the pivot axis formed by pivot 25. Movement of peg 723 of lever link 72 in guide slot 715 of locking plate 71 causes vertical movement of locking plate 71. When locking plate 71 is in its lowest position (i.e., the lower, locking position in which pin 27 reaches upper ends of vertical slots 714), lower end 712 of locking plate 71 is beside second lug 622 of hub 61, preventing rotation of hub 61 (FIG. 11). Namely, outer operating device 6 is locked, preventing unauthorized access through operation of thumb piece 64 (or lever handle 65). An anti-theft function is, thus, provided. Note that auxiliary locking device 8 prevents latch bolt 3 from being picked when locking plate 71 is in the lower, locking position. Outer operating device 6 can be unlocked by the key to move locking plate 71 upward to the upper, unlocking position. However, when door 11 is closed and when locking plate 71 is in its upper, unlocking position, latch bolt 3 can be retracted by operating operative member 42 or thumb piece 64 (or lever handle 65).

Figure 15:
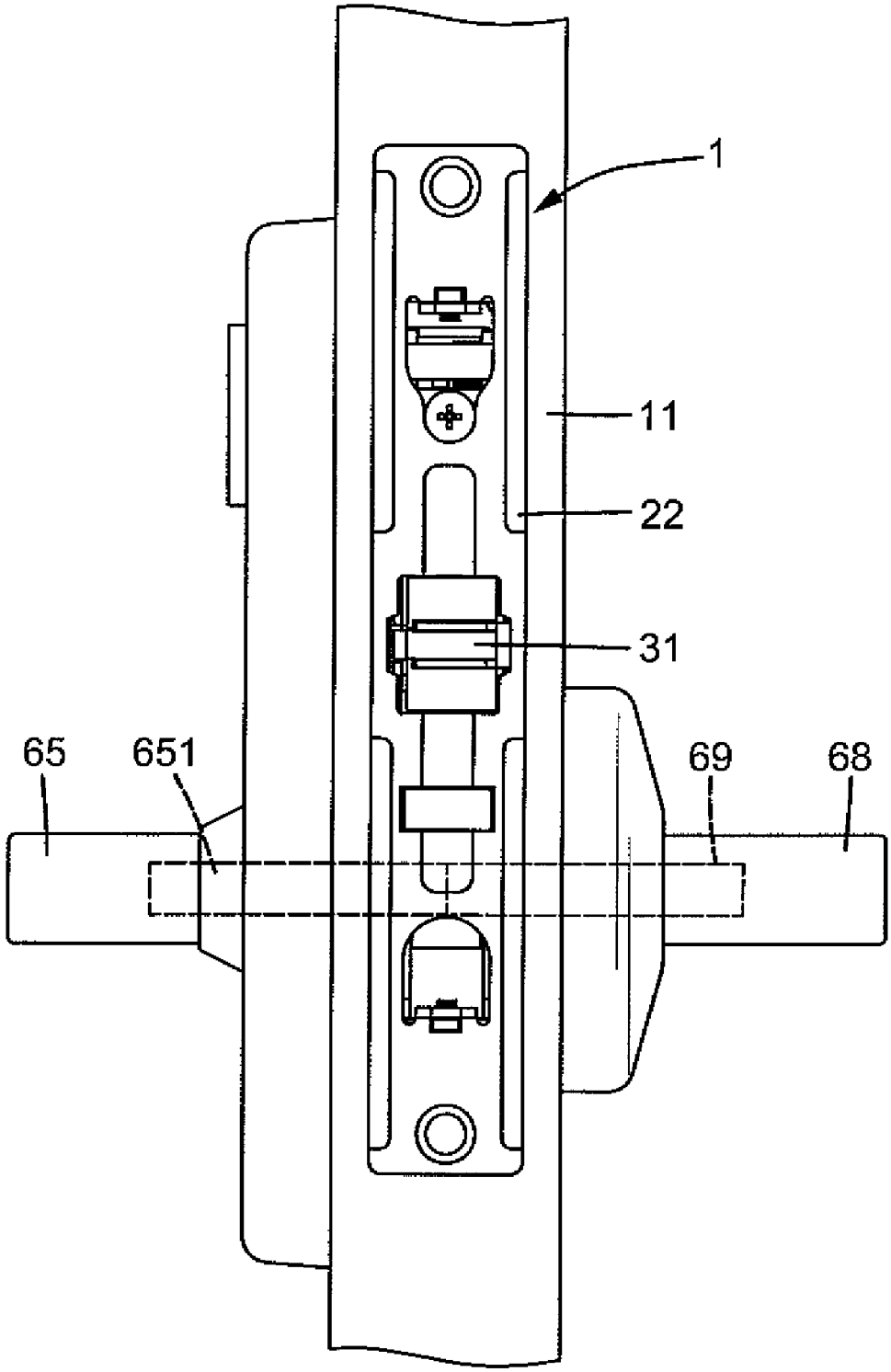
FIG. 15 shows an elevational view of the door and the mortise lock of FIG. 13 with an inner operating device of the mortise lock of FIG. 13 replaced with a lever handle.

Now that the basic teachings of the present invention have been explained, many extensions and variations will be obvious to one having ordinary skill in the art. For example, cylinder 51 can be mounted in cylinder hole 241 of sidewall 24 instead of cylinder hole 231 of sidewall 23. In this case, inner operating device 4 is mounted to the other side of door 11, and draw member 44 extends through slot 232 of sidewall 23. Second end 822 of stop 82 can have other shapes. For example, second end 822 of stop 82 can have L-shaped cross sections. If picking of latch bolt 3 is not a problem, auxiliary locking device 8 and outer operating device 6 can be omitted to save costs if desired. Inner operating device 4 can be replaced with an inner handle 68 operably coupled to retractor 35. In the most preferred form shown in FIG. 15, inner handle 68 is in the form of a lever handle having a spindle 69 with square cross sections engaged with spindle hole 611 of hub 61. Thus, when inner handle 68 is rotated, first lug 621 urges driving rod 66 to pivot about the pivot axis formed by pin 26, moving retractor 35 to the second position and moving head 31 to the retracted, unlatching position (c.f. FIG. 14). However, inner handle can be in the form of a press-type handle that extends through notch 233 of sidewall and operates like thumb piece 64. Specifically, the press-type handle can be pushed to move link 63 upward, which in turn, urges driving rod 66 to pivot about the pivot axis formed by pin 26, moving retractor 35 to the second position and moving head 31 to the retracted, unlatching position (c.f. FIG. 9).

Mortise lock 1 according to the preferred teachings of the present invention has a simple structure. As an example, locking device 7 of mortise lock 1 according to the preferred teachings of the present invention includes only three elements (locking plate 71, lever link 72, and resilient plate 74) while corresponding structure of the lock disclosed in U.S. Pat. No. 7,377,140 includes a lever link, a spring for returning the lever link, a follower plate, a locking plug, a rocker arm, and two drive members as well as other associated components. Mortise lock 1 according to the preferred teachings of the present invention can be utilized with a panic door (see door 11 in FIGS. 1-14) or an ordinary door (see door 11 in FIG. 15). When utilized with a panic door, the costs of mortise lock 1 according to the preferred teachings of the present invention are inexpensive due to simple structure. Furthermore, a user can select and utilize differing handles without modifying mortise lock 1 according to the preferred teachings of the present invention. Further, connecting member 9 allows the user to utilize mortise lock 1 according to the preferred teachings of the present invention according to needs. Specifically, locking plate 71 can be active or inactive according to the situation through simple mounting of connecting member 9 through one of arcuate slots 234 and 244 of sidewalls 23 and 24.

Thus since the invention disclosed herein may be embodied in other specific forms without departing from the spirit or general characteristics thereof some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A mortise lock comprising:

a case (2) adapted to be mounted in a door, with the case (2) including spaced first and second sidewalls (23, 24), with the first sidewall (23) including a first arcuate slot (234), with the second sidewall (24) including a second arcuate slot (244) aligned with the first arcuate slot (234);

a latch bolt (3) mounted in the case (2) and including a head (31) movable between an extended, latching position outside the case (2) and a retracted, unlatching position inside the case (2), with the latch bolt (3) farther including a retractor (35) mounted in the case (2) and coupled to the head (31) to move therewith, with the retractor (35) being movable between first and second positions corresponding to the extended, latching position and the retracted, unlatching position of the head (31);

a key-operable cylinder (51) rotatably mounted to one of the first and second sidewalls (23, 24), with the cylinder (51) including an actuating plate (512);

a follower (52) pivotably mounted in the case (2) and operably connected to and driven by the actuating plate (512), with the follower (52) being operably connected to the retractor (35) such that pivotal movement of the follower (52) in a first direction moves the retractor (35) from the first position to the second position, moving the head (31) of the latch bolt (3) from the extended, latching position to the retracted, unlatching position, with the follower (52) further including a first engaging hole (524) aligned with the first and second arcuate slots (234, 244);

a driving rod (66) including a first end (661) pivotably mounted to one of the sidewalls (23, 24) and a second end (662) coupled to the retractor (35) such that pivotal movement of the driving rod (66) in a second direction moves the retractor (35) from the first position to the second position, moving the head (31) of the latch bolt (3) from the extended, latching position to the retracted, unlatching position;

a hub (61) rotatably supported between the first and second sidewalls (23, 24) of the case (2), with the hub (61) including spaced first and second lugs (621, 622) extending outward from an outer periphery thereof, with the first lug (621) being operably connected to the driving rod (66) such that rotation of the hub (61) causes pivotal movement of the driving rod (66);

a locking plate (71) mounted in the case (2) and movable between an upper, unlocking position allowing pivotal movement of the driving rod (66) and a lower, locking position not allowing pivotal movement of the second lug (622) of the driving rod (66) and thus not allowing pivotal movement of the driving rod;

a lever link (72) mounted in the case (2) and between the first sidewall (23) and the follower (52), with the lever link (72) including a first end (721) operably connected to the locking plate (71) and a second end (722) pivotably mounted to one of the first and second sidewalls (23, 24) of the case (2) such that pivotal movement of the lever link (72) causes vertical movement of the locking plate (71) between the upper, unlocking position and the lower, locking position, with the lever link (72) further including a second engaging hole (725) aligned with the first and second arcuate slots (234, 244) and the first engaging hole (524); and a connecting member (9) selectively, removably, and slideably extended through to one of the first and second arcuate slots (234, 244) of the first and second sidewalls (23, 24), wherein when the connecting member (9) is slideably extended through the first arcuate slot (234) of the first sidewall (23), the connecting member (9) is extended through the second engaging hole (725) of the lever link (72) into the first engaging hole (524) of the follower (52), and the locking plate (71) is movable between the upper, unlocking position and the lower, locking position by rotation of the cylinder (51) through transmission by the lever link (72), and wherein when the connecting member (9) is slideably extended through the second arcuate slot (244) of the second sidewall (24), the connecting member (9) is engaged in the first engaging hole (524) and not engaged in the second engaging hole (725) of the lever link (72) such that the lever link (72) is not pivoted and the locking plate (71) is not moved when the cylinder (51) is rotated.

2. The mortise lock as claimed in claim 1, with the connecting member (9) being a screw, and with the first engaging hole (524) being a screw hole.

3. The mortise lock as claimed in claim 2, with the first sidewall (23) including a first pivot (25) formed on an inner face thereof with the second end (722) of the lever link (72) being pivotably mounted to the first pivot (25), with the follower (52) including first and second ends (521, 522) and an intermediate portion (523) having the screw hole (524), with the intermediate portion (523) of the follower (52) being pivotably mounted to the first pivot (25), with the first end (521) of the follower (52) being operably connected to the actuating plate (512) such that rotation of the cylinder (51) causes pivotal movement of the follower (52) about a first pivot axis formed by the first pivot (25), and with the second end (522) of the follower (52) being operably coupled to the retractor (35) such that pivotal movement of the follower (52) in the first direction moves the retractor (35) from the first position to the second position.

4. The mortise lock as claimed in claim 3, with the hub (61) further including a third lug (623) extending outward from the outer periphery thereof and spaced from the first and second lugs (621, 622), with the first sidewall (23) further including a second pivot (26) formed on the inner face thereof, with the first end (661) of the driving rod (66) being pivotably mounted to the second pivot (26), with the mortise lock further comprising, in combination: a link (63) including a first end (631) pivotably mounted to the second pivot (26), a second end (632), and an intermediate portion (633) operably connected to the driving rod (66); and a thumb piece (64) operably connected to the second end (632) of the link (63), with the link (63) pivoting about a second pivot axis formed by the second pivot (26) when thumb piece (64) is manually operated, urging the driving rod (66) to pivot about the second pivot axis and moving the retractor (35) from the first position to the second position.

5. The mortise lock as claimed in claim 4, with the hub (61) further including a spindle hole (611), with the mortise lock further comprising, in combination: a lever handle (65) including a spindle (651) securely coupled in the spindle hole (611), with the hub (61) being rotated when the lever handle (65) is rotated, with the first lug (621) urging the driving rod (66) to pivot about the second pivot axis and moving the retractor (35) from the first position to the second position.

6. The mortise lock as claimed in claim 4, with the locking plate (71) including an upper end (711) and a lower end (712) spaced from the upper end (711) in a vertical direction perpendicular to a moving direction of the retractor (35), with the locking plate (712) further including a guide slot (715) between the upper and lower ends (711, 712) and extending in a horizontal direction parallel to the moving direction of the retractor (35), with the first end (721) of the lever link (72) including a peg (723) slideably engaged in the guide slot (715) such that pivotal movement of the lever link (72) causes movement of the locking plate (72) between the upper, unlocking position and the lower, locking position.

7. The mortise lock as claimed in claim 6, with the lower end (712) of the locking plate (71) being U-shaped and including spaced, parallel first and second side plates (717) having aligned vertical slots (714) and an intermediate plate (718) interconnected between the first and second side plates (717), with the first sidewall (23) further including a pin (27) formed on the inner face thereof, with the vertical slots (714) slideably receiving the pin (27), allowing and guiding movement of the locking plate (71) in the vertical direction between the upper, unlocking position and the lower, locking position.

8. The mortise lock as claimed in claim 7, with the intermediate plate (718) of the locking plate (71) having a length slightly smaller than a spacing between the first and second sidewalls (23, 24), with the upper end (711) of the locking plate (71) including a bend (716) extending in a direction perpendicular to the horizontal and vertical directions and between the sidewalls (23, 24), with the bend (716) having a length slightly smaller than the spacing between the first and second sidewalls (23, 24).

9. The mortise lock as claimed in claim 8, with the locking plate (71) further including an ear (713), with the first sidewall (23) further including a groove (237) extending in the vertical direction and spaced from the pin (27) in the vertical direction, with the mortise lock further comprising, in combination: a resilient plate (74) mounted in the groove (237) and including a protruded portion (741) abutting at one of upper and lower sides of the ear (713) of the locking plate (71), with the ear (713) being movable between an upper position at an upper side of the protruded portion (741) of the resilient plate (74) corresponding to the upper, unlocking position of the locking plate (71) and a lower position at a lower side of the protruded portion (741) of the resilient plate (74) corresponding to the lower, locking position of the locking plate (71), with the protruded portion (741) retaining the locking plate (71) in one of the upper, unlocking position and the lower, locking position.

10. The mortise lock as claimed in claim 8, with the first sidewall (23) farther including a third pivot (28) formed on the inner face thereof, with the mortise lock further comprising, in combination:

an auxiliary bolt (81) including an auxiliary bolt head (811) movable between an extended position outside the case (2) and a retracted position inside the case (2), with the auxiliary bolt (81) further including a driven plate (815) in the case (2) and movable together with the auxiliary bolt head (811) between third and fourth positions corresponding to the extended position and retracted position of the auxiliary bolt head (811);

a stop (82) including first and second ends (821, 822) and an intermediate portion (823) between the first and second ends (821, 822), with the intermediate portion (823) of the stop (83) being pivotably mounted to the third pivot (28), with the first end (821) of the stop (82) being operably connected to the driven plate (815), with a protrusion (824) extending outward from the intermediate portion (823) of the stop (82), with the auxiliary bolt head (811) being in the retracted position when the door is closed, with the driven plate (815) disengaged from the first end (821) of the stop (82) and with the second end (822) of the stop (82) in a retraction path of the head (31) from the first position to the second position, preventing retraction of the head (31), with the second end (822) of the stop (82) being moved by the driven plate (815) to a position out of the retraction path of the retractor (35) when the auxiliary bolt head (81) moves from the retracted position to the extended position; and an unlocking lever (83) including first and second ends (831, 832) and an intermediate section (833) between the first and second ends (831, 832), with the intermediate section (833) being pivotably mounted to the first pivot (25), with the first end (831) of the unlocking lever (83) being located in the retraction path of the retractor (35) such that the unlocking lever (83) pivots in a third direction about the first pivot axis when the retractor (35) comes in contact with and actuates the unlocking lever (83) during movement of the retractor (35) from the first position to the second position, with the second end (832) of the unlocking lever (83) engaging with the protrusion (824) of the stop (82), with the pivotal movement of the unlocking lever (83) in the third direction causing pivotal movement of the stop (82) about a third pivot axis formed by the pivot (28) to the position not hindering retraction of head (3).

11. The mortise lock as claimed in claim 10, further comprising, in combination: an inner handle (68) including a spindle (69) securely coupled in the spindle hole (611), with the hub (61) being rotated when the lever handle (65) is rotated, with the first lug (621) urging the driving rod (66) to pivot about the second pivot axis and moving the retractor (35) from the first position to the second position.

* * * * *